US007917066B2

(12) United States Patent
Ootsuka

(10) Patent No.: US 7,917,066 B2
(45) Date of Patent: Mar. 29, 2011

(54) DEVELOPING APPARATUS AND IMAGE FORMING APPARATUS

(75) Inventor: Masahiro Ootsuka, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/578,756

(22) Filed: Oct. 14, 2009

(65) Prior Publication Data

US 2010/0098447 A1 Apr. 22, 2010

(30) Foreign Application Priority Data

Oct. 22, 2008 (JP) ..... 2008-271571

(51) Int. Cl.
*G03G 15/08* (2006.01)

(52) U.S. Cl. ..... 399/254; 399/53; 399/256

(58) Field of Classification Search ..... 399/53, 399/254–256, 258
See application file for complete search history.

(56) References Cited

U.S. PATENT DOCUMENTS 7,248,825 B2 * 7/2007 Nishitani et al. ..... 399/258
7,729,641 B2 * 6/2010 Suzuki ..... 399/254

FOREIGN PATENT DOCUMENTS

JP 5-333691 A 12/1993
JP 2003-186293 A 7/2003
JP 2005-292511 A 10/2005

* cited by examiner

*Primary Examiner* — Hoang Ngo

(74) *Attorney, Agent, or Firm* — Fitzpatrick, Cella, Harper & Scinto

(57) ABSTRACT

The image forming apparatus includes a developing chamber an agitating chamber, a first conveying screw which is arranged in the developing chamber and coveys developer from one end to the other end of the first chamber, a second conveying screw which is arranged in the agitating chamber and conveys developer from one end to the other end of the second chamber, a developing sleeve which bears developer supplied from the developing chamber and conveys the developer to the agitating chamber via a developing area opposed to a photosensitive drum, motors, which drive the developing sleeve, the first conveying screw and the second conveying screw, and a controller which controls drive of the developing sleeve and the second conveying screw so that trigger timing of drive stopping of at least the second conveying screw is to be later than trigger timing of drive stopping of the developing sleeve.

6 Claims, 10 Drawing Sheets

DEVELOPING APPARATUS AND IMAGE FORMING APPARATUS

BACKGROUND OF THE INVENTION

1. Field of the Invention

The present invention relates to a developing apparatus used in an image forming apparatus with an electrophotographic system or an electrostatic recording system, such as a copying machine, which visualizes an electrostatic image formed on an image bearing member by fixing developer thereto and an image forming apparatus having the developing apparatus.

2. Description of the Related Art

Recently, for an image forming apparatus with an electrophotographic system, such as a copying machine and a printer, there has been a strong demand for downsizing the apparatus main body in order to save space. In particular, for an image forming apparatus of a full-color mode, the demand for downsizing is growing since a plurality of developing apparatuses are mounted. An invention of a developing apparatus which fulfills such a demand has been disclosed in Japanese Patent Application Laid-open (JP-A) No. 5-333691.

The developing apparatus disclosed in JP-A No. 5-333691 includes a developing chamber for supplying developer to a developing sleeve and an agitating chamber for collecting the developer after developing into a developer container. The developing chamber and the agitating chamber are arranged up and down. Such arrangement is described with reference to FIG. 2 in this application.

The developing apparatus 1 in FIG. 2 has a feature that two conveying screws 5, 6 as developer circulation unit are arranged up and down. The developing apparatus 1 has the developer container 2 for accommodating the developer. An opening portion 2*a* is formed at a part of the developer container 2 opposed to a photosensitive drum 10. A developing sleeve 8 as a developer bearing member is provided at the opening portion 2*a*.

Further, a partition wall 7 extending toward the opening portion 2*a* is formed at an inner wall of the developer container 2. The partition wall 7 partitions the developing chamber 3 and the agitating chamber 4. The developing chamber 3 is arranged at the upper side in the developer container 2 and the agitating chamber 4 is arranged at the lower side in the developer container 2. A first conveying screw 5 and a second conveying screw 6 are provided respectively in the developing chamber 3 and the agitating chamber 4 as the circulation unit for circulating the developer within the developer container 2 while agitating and conveying the developer. The first conveying screw 5 conveys the developer in the developing chamber 3 to the developing sleeve 8. The second conveying screw 6 uniforms toner density of the developer by agitating and conveying toner which is supplied to the upstream side of the second conveying screw 6 in the agitating chamber 4 from a toner supplying port (not illustrated) with the developer which is previously contained in the agitating chamber 4.

With the developing apparatus 1 of such a vertical agitation type, the occupying space in the horizontal direction is saved since the developing chamber 3 and the agitating chamber 4 are vertically lined. Accordingly, for example, downsizing in the horizontal direction can be achieved even with a color image forming apparatus of a tandem type having a plurality of developing apparatuses 1 mounted in parallel in the horizontal direction.

In the developing apparatus 1 of the vertical agitation type, the developer is drawn to the developing sleeve 8 with a magnetic pole N1 of a magnet roller 8*a* as magnetic field generating unit which is provided non-rotatably at the inside of the developing sleeve 8, as indicated by arrow a in FIG. 2. In this case, the magnetic pole N1 is arranged within the developer container 2.

When the developing sleeve 8 is rotated, the developer is conveyed from the inside to the outside of the developer container 2 by being sequentially conveyed to a magnetic pole S1 and then to a magnetic pole N2 which is at a part of the developer sleeve 8 exposed to the photosensitive drum 10 side. Then, the developer arrives at a developing area having a magnetic pole S2 which is opposed to the developing sleeve 8 and the photoconductive drum 10. At the midway of conveying the developer, the thickness of the developer is magnetically regulated in cooperation with a developer regulating edge 9 as a developer regulating member and the magnetic pole S1 which is arranged to be opposed thereto. Thus, the layer of the developer is thinned and an electrostatic image is developed at the developing area.

The remaining developer without being used for the developing at the developing area is conveyed into the developer container 2 with a magnetic pole N3 which is arranged at the downstream side of the developing area in the rotation direction of the developing sleeve 8. The developer is removed from the developing sleeve 8 by a repulsing magnetic field of the same polarity magnetic poles N1, N3 which are adjacently arranged at the inner side of the developer container 2. Then, the developer is collected into the agitating chamber 4 which is defined at the lower part in the developer container 2.

In this case, the developer is not collected into the developing chamber in accordance with the rotation of the developing sleeve 8 unlike a developing apparatus of the horizontal agitation type. As indicated by arrow c in FIG. 2, the developer is collected into the agitating chamber 4 which is defined vertically below the developing chamber 3. Thus, the only developer which is sufficiently agitated in the agitating chamber 4 invariably exists in the developer container 2. In this manner, the developing sleeve 8 is invariably provided with the developer of uniformed density so that steady images without unevenness and darkness difference in the thrust direction can be obtained.

Meanwhile, the image forming apparatus is required to be capable of accepting various media. For example, the process speed can be set variously and is set slow in the case of a thick sheet. At that time, when the developer conveyance capacity of the second conveying screw 6 is set smaller than that of the developing sleeve 8, the developer is accumulated at the upstream side of the second conveying screw 6 and the circulation of the developer becomes out of balance. For this reason, the developing sleeve 8 and the second conveying screw 6 are independently driven and set to be at the appropriate rotation speed for each process speed so as to prevent the developer circulation from being out of balance at any process speed.

However, with the configuration of the developing apparatus 1 of the vertical agitation type in JP-A No. 5-333691, the following problem remains with the developer conveyance.

There is a difference between inertia forces of the developing sleeve 8 and the second conveying screw 6. Accordingly, there arises a difference between a stop turnaround time until the rotation of the developing sleeve 8 is stopped based on a drive stop trigger signal and a stop turnaround time until the rotation of the second conveying screw 6 is stopped based on a drive stop trigger signal.

Here, it is assumed that a motor 11 of the developing sleeve 8 and a motor 12 of the second conveying screw 6 simultaneously receives the drive stop trigger signal. In this case, due to the difference of the stop turnaround times, the developing sleeve 8 is rotated longer than the second conveying screw 6, for example. Accordingly, there may be a case that the developer is excessively conveyed from the developing chamber 3 to the agitating chamber 4 via the developing sleeve 8. In the case that redundant rotation of the developing sleeve 8 is repeated corresponding to repeating of the drive start and the drive stop of the developing sleeve 8 and the second conveying screw 6, the developer circulation becomes out of balance. Then, there is a risk that, in the end, the developer overflows from the developing apparatus 1.

The present invention provides a developing apparatus which is capable of suppressing overflowing of developer from the developing apparatus due to imbalance of developer circulation even with difference between stop turnaround times caused by difference between inertia forces of the developer bearing member and a conveying member.

SUMMARY OF THE INVENTION

The present invention provides an image forming apparatus which includes: a first chamber which is capable of accommodating developer; a second chamber which is capable of accommodating developer and forms a circulation passage in communication with the first chamber; a first conveying member which is arranged in the first chamber and conveys developer from one end to the other end of the first chamber; a second conveying member which is arranged in the second chamber and conveys developer from one end to the other end of the second chamber; a developer bearing member which bears developer supplied from the first chamber and conveys the developer to the second chamber via a developing position opposed to an image bearing member; a drive mechanism which drives the developer bearing member, the first conveying member and the second conveying member; and a controller which controls drive of the drive mechanism so that stop timing of drive input for the developer bearing member is to be earlier than stop timing of drive input for the second conveying member in a case of stopping drive of the developer bearing member in accordance with image forming completion.

Further features of the present invention will become apparent from the following description of exemplary embodiments (with reference to the attached drawings).

DESCRIPTION OF THE EMBODIMENTS

First Embodiment

Figure 1:
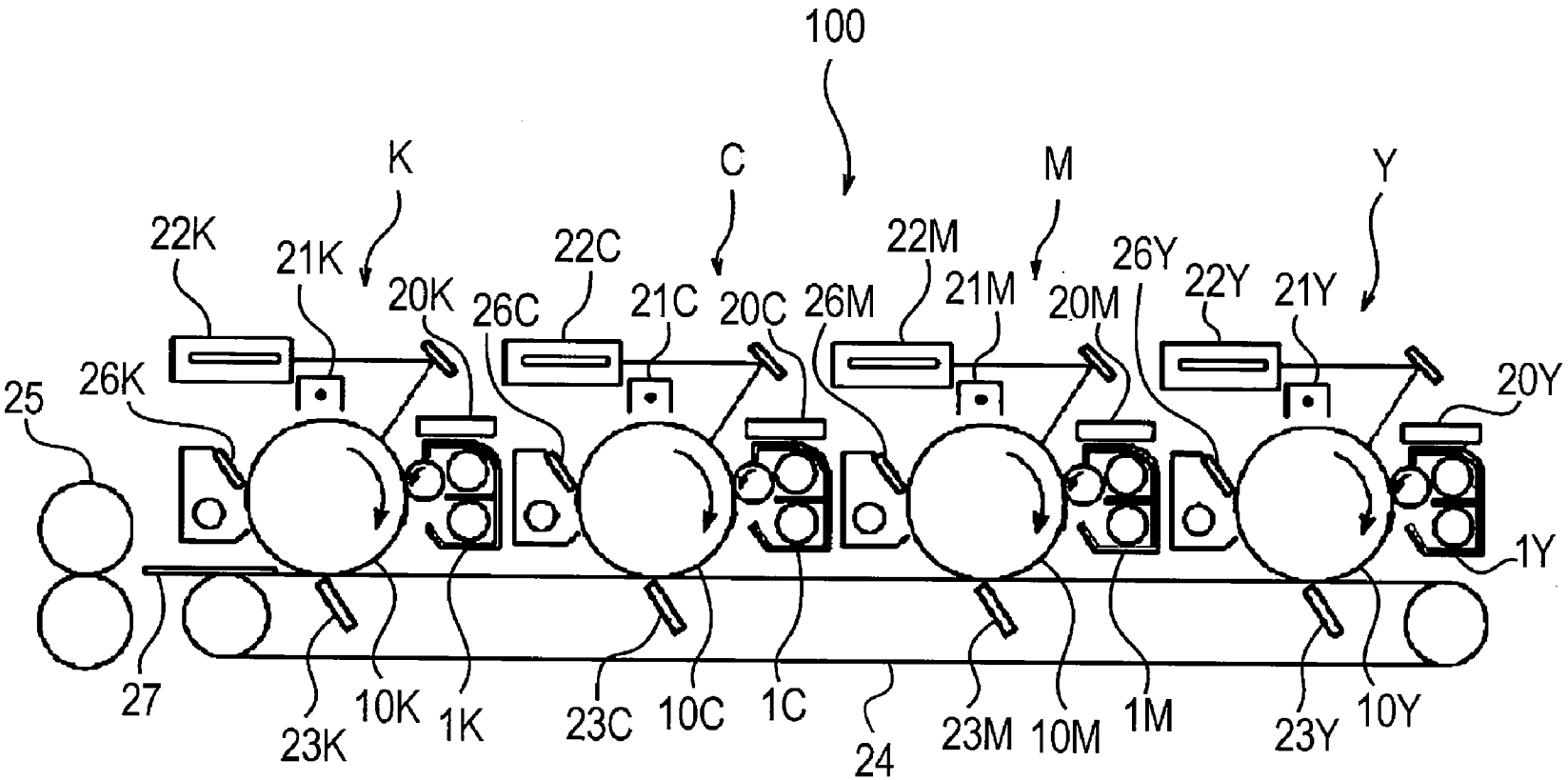
FIG. 1 is a sectional view which illustrates the configuration of an image forming apparatus including a developing apparatus according to a first embodiment of the present invention.

FIG. 1 is a sectional view which illustrates the configuration of an image forming apparatus 100 including a developing apparatus 1 according to a first embodiment of the present invention. First, the general configuration and operation of the image forming apparatus 100 is described with reference to FIG. 1. In the following, the image forming apparatus 100 is described as a full-color image forming apparatus as an example.

As illustrated in FIG. 1, each of a station Y, a station M, a station C and a station K has almost the same configuration and forms an image of a color of respective yellow (Y), magenta (M), cyan (C) and black (K) in a full-color image. Each station Y, M, C, K is respectively provided with each developing apparatus 1Y, 1M, 1C, 1K. In the following description, the developing apparatus 1 commonly denotes the developing apparatuses 1Y, 1M, 1C, 1K of each the station Y, M, C, K.

Further, each station Y, M, C, K is respectively provided with a photosensitive drum 10Y, 10M, 10C, 10K as an image bearing member. In the following description, the photosensitive drum 10 commonly denotes the photosensitive drums 10Y, 10M, 10C, 10K of each the station Y, M, C, K. The photosensitive drum 10 is rotatably arranged and evenly charged by a primary charger 21. Then, the electrostatic image is formed by exposing with light modulated in accordance with information signals by a light emitting element 22 such as laser.

Here, each station Y, M, C, K is respectively provided with a primary charger 21Y, 21M, 21C, 21K. The primary charger 21 commonly denotes the four chargers. Further, each station Y, M, C, K is respectively provided with a light emitting element 22Y, 22M, 22C, 22K. The light emitting element 22 denotes the four emitting elements.

The electrostatic image is visualized as a developed image (hereinafter, called a toner image) with the later-mentioned processes by the developing apparatus 1. Meanwhile, a transfer sheet 27 as a recording material is conveyed to a transfer charger 23 by a transfer sheet conveying member 24. The above-mentioned toner image is transferred on the transfer sheet 27 for each station by the transfer charger 23. Subsequently, a permanent image can be obtained by being fixed by a fixing device 25.

Remaining toner on the photosensitive drum 10 after the transfer is removed by a cleaning device 26. The toner in the consumed developer for the image forming is replenished from a toner supplying tank 20.

Here, each station Y, M, C, K is respectively provided with a cleaning device 26Y, 26M, 26C, 26K. The cleaning device 26 commonly denotes the four cleaning devices 26. Further, each station Y, M, C, K is respectively provided with a toner supplying tank 20Y, 20M, 20C, 20K. The toner supplying tank 20 commonly denotes the four toner supplying tanks. Furthermore, each station Y, M, C, K is respectively provided with a transfer charger 23Y, 23M, 23C, 23K. The transfer charger 23 commonly denotes the four transfer chargers.

Here, an image forming portion for forming an image on a sheet is configured to include the above-mentioned photosensitive drum 10 and the developing apparatus 1.

The present embodiment adopts the method to transfer from the photosensitive drums 10M, 10C, 10Y, 10K as the image bearing members directly to the transfer sheet 27 which is conveyed to the transfer sheet conveying member 24. However, it is not limited to this method.

The developing apparatus 1 is also applicable to an image forming apparatus which is configured to include an intermediate transfer member instead of the transfer sheet conveying member 24 and to secondarily transfer a mixed toner image of every color on the transfer sheet 27 after a toner image of each color is primarily transferred to the intermediate transfer member respectively from the photosensitive drum 10 of each color.

Figure 2:
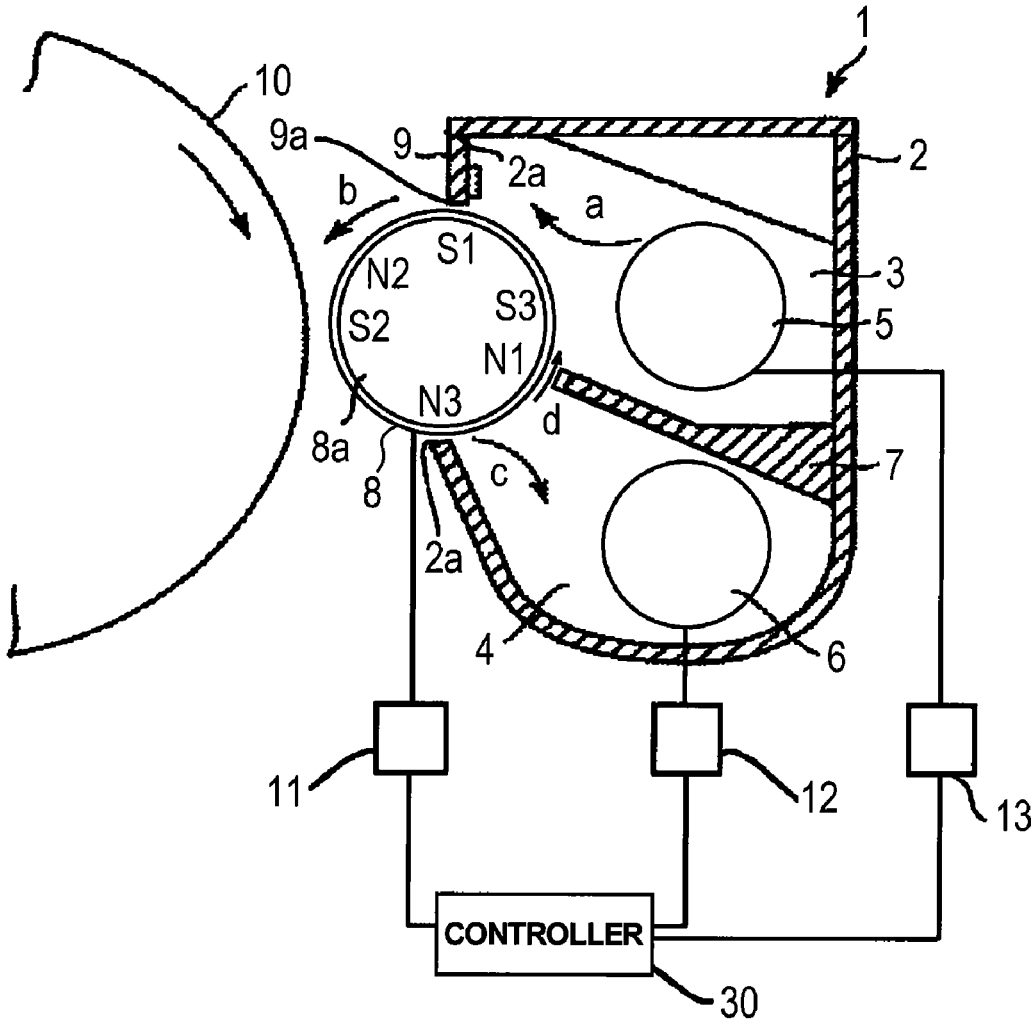
FIG. 2 is an enlarged sectional view which illustrates the configuration of a photosensitive drum and the developing apparatus according to the first embodiment of the present invention.

FIG. 2 is an enlarged sectional view which illustrates the configuration of the photosensitive drum 10 and the developing apparatus 1 according to the first embodiment of the present invention. As illustrated in FIG. 2, the developing apparatus 1 has the developer container 2 capable of accommodating the developer T (for example, two-component developer) which includes nonmagnetic toner and magnetic carrier. The opening portion 2*a* is formed at apart of the developer container 2 opposed to the photosensitive drum 10. The developer regulating edge 9 as the developer regulating member is attached to an end part of the opening portion 2*a*. The developing sleeve 8 as a developer bearing member is rotatably arranged at a position surrounded by a top end 9*a* of the developer regulating edge 9 and the opening portion 2*a*. The developing sleeve 8, having the top end 9*a* and the opening portion 2*a* as the boundary, is arranged so that a part thereof is exposed to the photosensitive drum 10 side and another part thereof is to be inside the developer container 2.

The developing sleeve 8 is arranged to be opposed to the photosensitive drum 10. The developing sleeve 8 bears the developer T in the developing chamber 3 and conveyed to the photosensitive drum 10. The developing sleeve 8 conveys the developer T to the agitating chamber 4 via the developing area opposed to the photosensitive drum 10 while bearing the developer T supplied from the developing chamber 3.

A partition wall 7 is formed at an approximate center part of the inside of the developer container 2. The partition wall 7 partitions, within the developer container 2, a developing chamber 3 as a first chamber capable of accommodating the developer T for developing therewith and an agitating chamber 4 as a second chamber for forming a circulation passage in communication with the developing chamber 3 and for agitating the developer T while being capable of accommodating the developer T. The developing chamber 3 is defined at the upper side in the developer container 2. The agitating chamber 4 is defined at the lower side in the developer container 2. Namely, the agitating chamber 4 is arranged below the developing chamber 3 in the gravitational direction. The developer T is accommodated in the developer container 2 having the developing chamber 3 and the agitating chamber 4 which are arranged up and down.

The first conveying screw 5 as the first conveying member which agitates the developer T in the developing chamber 3 and conveys to the developing sleeve 8 is arranged within the developing chamber 3. The second conveying screw 6 as the second conveying member which agitates the developer T in the agitating chamber 4 and conveys to the developing chamber 3 when the developer T remained at the developing sleeve 8 is collected into the agitating chamber 4 is arranged within the agitating chamber 4. The first conveying screw 5 or the second conveying screw 6 functions as the circulation unit for circulating the developer T within the developer container 2.

Here, the developing sleeve 8 is configured with a nonmagnetic unit. The magnet roller 8*a* as the magnetic field generating unit is arranged non-rotatably at the inside of the developing sleeve 8. The magnet roller 8*a* includes a magnetic pole S2 as the developing pole and magnetic poles S1, N1, N2, N3 for conveying the developer T. The magnetic pole N3 and the magnetic pole N1 having the same polarity are arranged at the inner side of the developer container 2 being adjacent each other. Accordingly, the repulsing magnetic field is formed between the magnetic pole N3 and the magnetic pole N1, so that a barrier for the developer T is formed. Therefore, the developer T is removed from the developing sleeve 8 at the agitating chamber 4.

The developing sleeve 8 is connected to a motor 11 as the first motor as being a drive mechanism. The second conveying screw 6 is connected to the motor 12 as the second motor as being a drive mechanism. The first conveying screw 5 is connected to the motor as the third motor 13 as being a drive mechanism. The motors 11 to 13 are connected to a controller 30 as a control portion. Since the motor 11, the motor 12 and the motor 13 are capable of being independently controlled, the developing sleeve 8, the second conveying screw 6 and the first conveying screw 5 are capable of being independently driven.

Figure 3:
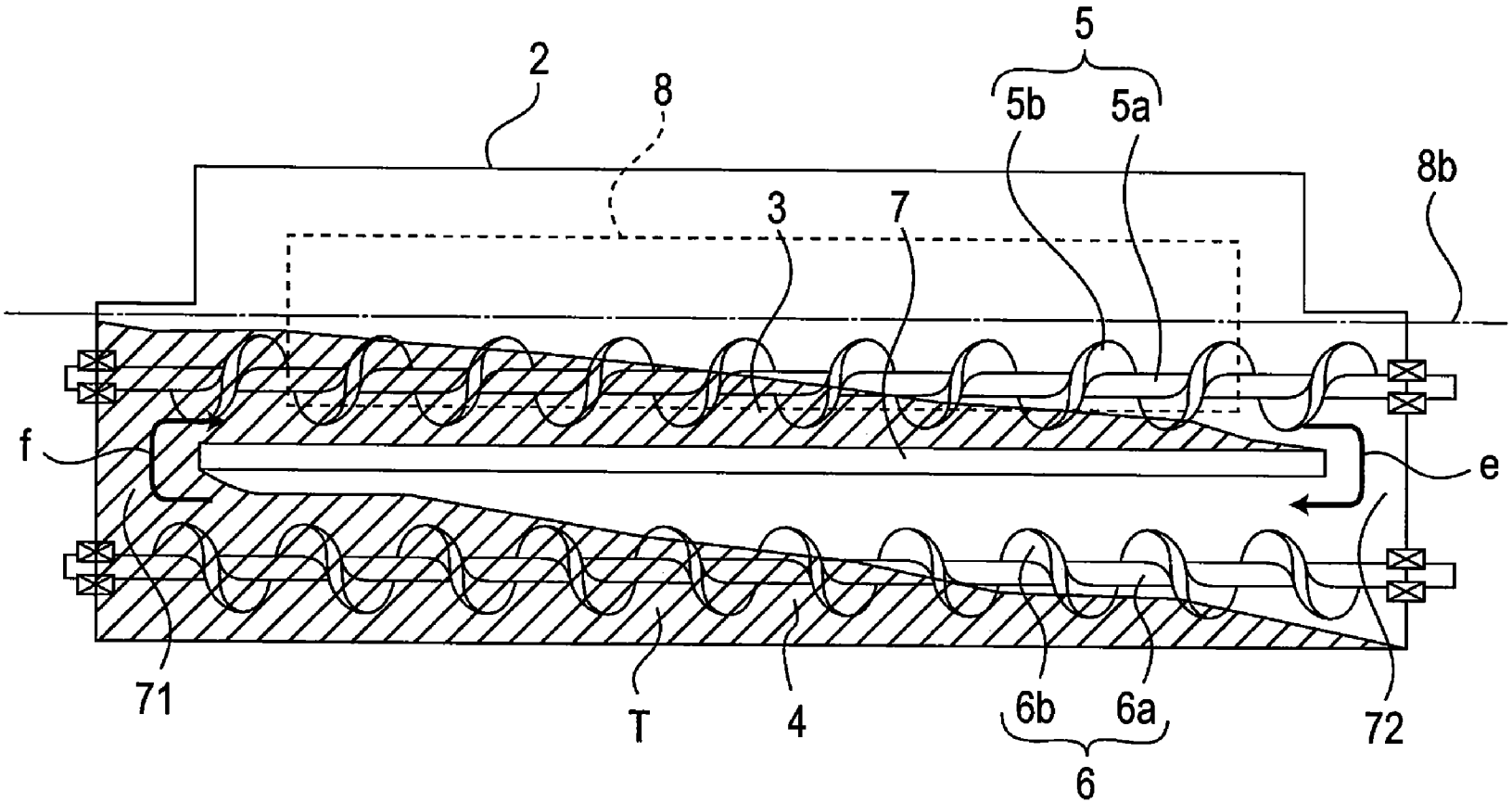
FIG. 3 is a sectional view which illustrates the configuration of the developing apparatus.

In order to suppress accumulation of the developer at a communicating portion 71, which is described later with FIG. 3, for drawing the developer from the agitating chamber 4 to the developing chamber 3, the controller 30 is capable of adjusting the drive order of the developing sleeve 8, the second conveying screw 6 and the first conveying screw 5. In FIG. 3, when the developer is drawn through the communicating portion 71 with the drive of the second conveying screw 6 after the first conveying screw 5 is stopped, the developer overflows at the vicinity of the communicating portion 71. In addition, when the developer is added to the communicating portion 71 with the drive of the developing sleeve 8 after the first conveying screw 5 and the second conveying screw 6 are stopped, the communicating portion 71 is further overflowed.

In order to suppress such a phenomenon, the controller 30 is capable of storing data of a first stop turnaround time from transmitting of a first drive stop trigger signal for stopping the drive of the developing sleeve 8 until the stopping of the drive of the developing sleeve 8. Further, the controller 30 is capable of storing data of a second stop turnaround time from transmitting a second stop trigger signal for stopping the drive of the second conveying screw 6 until the stopping of the second conveying screw 6. Furthermore, the controller 30 is capable of storing data of a third stop turnaround time from transmitting a third drive stop trigger signal for stopping the drive of the first conveying screw 5 until the stopping of the first conveying screw 5.

In addition, the controller 30 is capable of transmitting the first drive stop trigger signal to the developing sleeve 8 for triggering the drive stop of the developing sleeve 8 based on the data of the first stop turnaround time. Further, the controller 30 is capable of transmitting the second drive stop trigger signal to the second conveying screw 6 for triggering the drive stop of the second conveying screw 6 based on the data of the second stop turnaround time. Furthermore, the controller 30 is capable of transmitting the third drive stop trigger signal to the first conveying screw 5 for triggering the drive stop of the first conveying screw 5 based on the data of the third stop turnaround time.

The above-mentioned drive stop trigger signals are transmitted in the following order. First, the controller 30 transmits the first drive stop trigger signal to the developing sleeve 8 based on the data of the first stop turnaround time. Then, the controller 30 transmits the second drive stop trigger signal to the second conveying screw 6 based on the data of the second stop turnaround time. Subsequently, the controller 30 transmits the third drive stop trigger signal to the first conveying screw 5 based on the data of the third stop turnaround time.

Accordingly, based on the first stop turnaround time, the second stop turnaround time and the third stop turnaround time, the controller 30 stops the drive of the second conveying screw 6 after the drive of the developing sleeve 8 is stopped, and then, the controller 30 stops the drive of the first conveying screw 5. Instead, the drives of the developing sleeve 8, the second conveying screw 6 and the first conveying screw 5 may be simultaneously stopped based on the data of the first stop turnaround time, the second stop turnaround time and the third stop turnaround time.

FIG. 3 is a sectional view which illustrates the configuration of the developing apparatus 1. As illustrated in FIG. 3, a rotation shaft 5*a* of the first conveying screw 5 is arranged to be approximately parallel to the rotation center 8*b* of the developing sleeve 8 (i.e., the approximate developing width direction) at the bottom of the developing chamber 3. When the first conveying screw 5 is rotated, the developer T in the developing chamber 3 is conveyed in one direction (i.e., from the left to the right in FIG. 3) along the rotation shaft 5*a* of the first conveying screw 5. The first conveying screw 5 is formed to be a screw configuration including the rotation shaft 5*a* formed of ferromagnetic material and a blade member 5*b* formed of nonmagnetic material arranged to be spiral-shaped around the rotation shaft 5*a*.

Further, as illustrated in FIG. 3, a rotation shaft 6*a* of the second conveying screw 6 is arranged to be approximately parallel to the rotation center 8*b* of the developing sleeve 8 and the rotation shaft 5*a* of the first conveying screw 5 (i.e., the approximate developing width direction) at the bottom of the agitating chamber 4. When the second conveying screw 6 is rotated in the same direction as the first conveying screw 5, the developer T in the agitating chamber 4 is conveyed in the other direction (i.e., from the right to the left in FIG. 3) along the rotation shaft 6*a* of the second conveying screw 6. The second conveying screw 6 is formed to be a screw configuration including the rotation shaft 6*a* formed of ferromagnetic material and a blade member 6*b* formed of nonmagnetic material arranged to be spiral-shaped around the rotation shaft 6*a*.

Further, as illustrated in FIG. 3, the communicating portion 71 and a communicating portion 72 are formed as the opening portions at the partition wall 7 formed between the developing chamber 3 and the agitating chamber 4 at both ends in the direction along the rotation center 8*b* of the developing sleeve 8. Then, when the developer T is conveyed with the rotation of the first conveying screw 5 and the second conveying screw 6, the developer T is circulated between the developing chamber 3 and the agitating chamber 4 through the opening portions (i.e., the communicating portions 71, 72) at both ends of the partition wall 7.

As clearly seen from FIGS. 2 and 3, the developing chamber 3 is arranged at the vertical upside and the agitating chamber 4 is arranged at the vertical downside. Regarding movement from the developing chamber 3 to the agitating chamber 4, the developer T is moved from the upside to the downside though the communicating portion 72, as indicated by arrow e. Regarding movement from the agitating chamber 4 to the developing chamber 3, the developer T is moved from the downside to the upside through the communicating portion 71, as indicated by arrow f. Specifically, regarding the movement from the agitating chamber 4 to the developing chamber 3, the developer T is passed by being pressed up from the downside to the upside with the pressure of the developer T accumulated at the end.

Here, the developer T is prone to be accumulated at the vicinity of the communicating portion 71 in the agitating chamber 4 for passing to the developing chamber 3 from the agitating chamber 4, as illustrated in FIG. 3. Accordingly, the developer T is prone to overflow at the vicinity of the communicating portion 71.

Additionally, the overflowing proneness of the developer T at the vicinity of the communicating portion 71 is described in the following. As illustrated in FIG. 3, in the developing apparatus 1 of the vertical agitation type, the developer T flows in the direction indicated by arrows e, f. The developer T is passed to the developing chamber 3 from the agitating chamber 4 through the communicating portion 71 out of the openings of the communicating portions 71, 72 arranged at both ends in the axis direction of the partition wall 7 which partitions the developing chamber 3 and the agitating chamber 4.

Here, not all of the developer T arrives at the downstream end of the first conveying screw 5 at the developing chamber 3. There exists some components supplied to the developing sleeve 8 on the midway (see FIG. 2) and collected into the agitating chamber 4 after passing through the developing area. The passing of the developer T to the developing sleeve 8 is performed almost all over the developing sleeve 8 in the thrust direction. Therefore, the amount of the developer T conveyed by the first conveying screw 5 within the developing chamber 3 tends to be gradually decreased toward the downstream end from the upstream end in the conveying direction.

On the other hand, the amount of the developer T conveyed by the second conveying screw 6 within the agitating chamber 4 tends to be gradually increased toward the downstream end from the upstream end in the conveying direction. Namely, unevenness of the distribution of the developer T is highly caused within the developing apparatus 101 as illustrated in FIG. 3. In light of the configuration of FIG. 2 in such a situation, in the case that the developing sleeve 8 is still rotated after the second conveying screw 6 is stopped, the amount of the developer Tin the agitating chamber 4 is further increased. Then, the amount of the developer T is particularly increased at the downstream side in the agitating chamber 4. Accordingly, it becomes difficult to collect the developer T from the developing sleeve 8 to the agitating chamber 4 at the vicinity of the communicating portion (also called drawing portion) 71. In this case, the developer T flows on the developing sleeve 8 and overflowing is caused. Accordingly, it becomes even more difficult to collect the developer T from the developing sleeve 8 to the agitating chamber 4. The developer T which is not collected flows on the developing sleeve 8 and leaking is caused.

Here, the drive stop timing of the first conveying screw 5 is set to be later than or equal to the drive stop timing of the second conveying screw 6 in consideration with the pressure applied to the developer at the communicating portion (i.e., the drawing portion) 71. Assuming that the rotation of the second conveying screw 6 in the agitating chamber 4 is stopped after the rotation of the first conveying screw 5 in the developing chamber 3 is stopped, the pressure of the developer is increased at the communicating portion 71 by the rotation of the second conveying screw 6 and the developer is deteriorated. The above-mentioned operation is for suppressing such deterioration.

Figure 4:
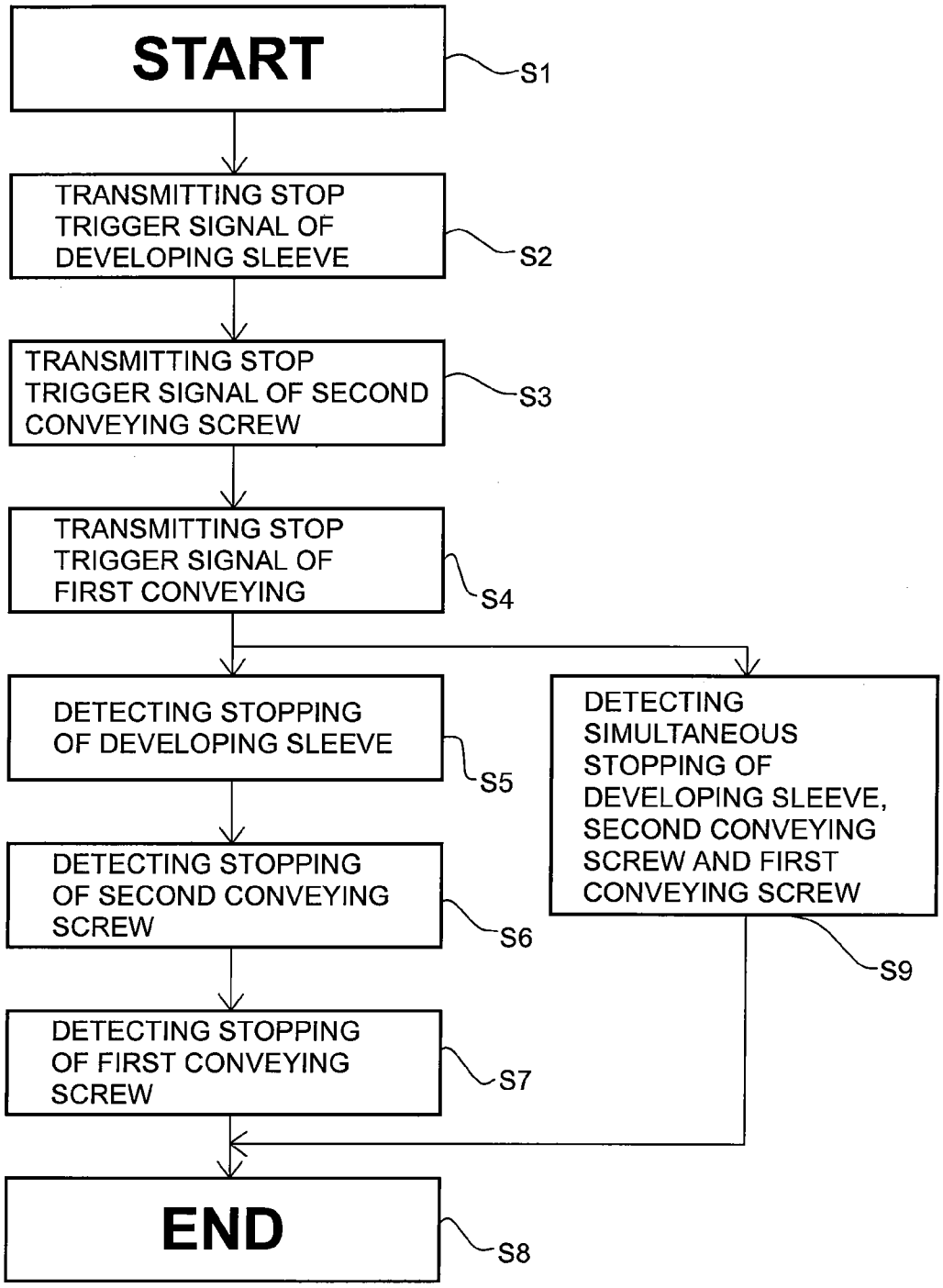
FIG. 4 is a flowchart which describes control processes of a controller.

FIG. 4 is a flowchart which describes control processes of the controller 30. As described in FIG. 4, the controller 30 starts the operation in step S1 (hereinafter, the step is denoted by S). The controller 30 transmits the first drive stop trigger signal for triggering stopping of the drive of the developing sleeve 8 to the motor 11 in S2. Then, the controller 30 transmits the second drive trigger signal for triggering stopping of the drive of the second conveying screw 6 to the motor 12 in S3. Subsequently, the controller 30 transmits the third drive stop trigger signal for triggering stopping of the drive of the first conveying screw 5 to the motor 13 in S4.

The controller 30 detects the stopping of the rotation of the developing sleeve 8 based on a signal received from a rotation detecting sensor (not illustrated) of the developing sleeve 8 in S5. Then, the controller 30 detects the stopping of the second conveying screw 6 based on a signal of a rotation detecting sensor (not illustrated) of the second conveying screw 6 in S6. Subsequently, the controller 30 detects the stopping of the rotation of the first conveying screw 5 based on a signal received from a rotation sensor (not illustrated) of the first conveying screw 5 in S7. Then, the controller 30 ends the operation in S8.

Further, as mentioned above, the simultaneous stopping of the developing sleeve 8, the second conveying screw 6 and the first conveying screw 5 may be detected in S9 with rotation detecting sensors (not illustrated) after the controller 30 transmits the third drive stop trigger signal to the motor 13 in S4.

Here, as mentioned above, the stop timings of the developing sleeve 8, the second conveying screw 6 and the first conveying screw 5 may be transposed within a predetermined time range after the controller 30 transmits the third drive stop trigger signal to the motor 13 in S4.

Figure 5A:
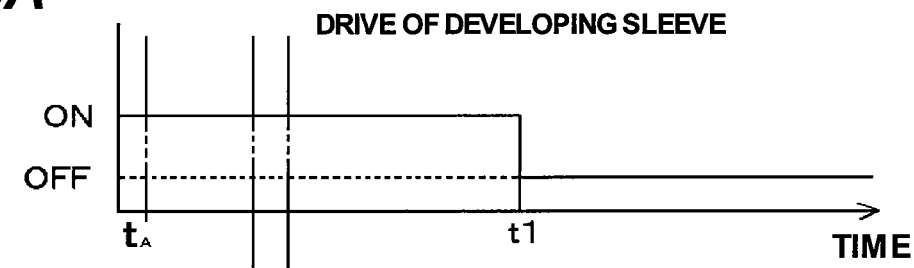
FIGS. 5A, 5B and 5C are graphs which illustrate a situation of sequential stopping of a developing sleeve, a second conveying screw and a first conveying screw while respective drive stop trigger signals are transmitted with respectively shifted drive timings thereof.
Figure 5B:
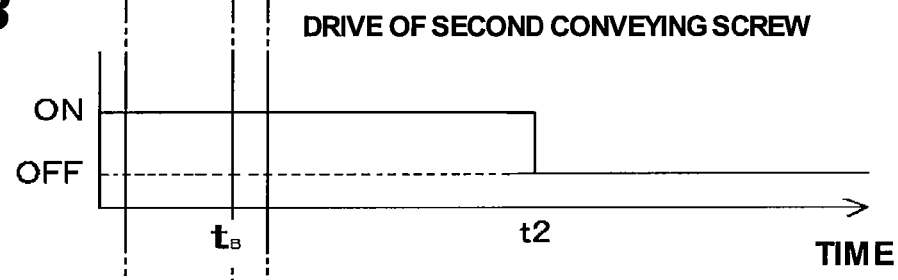
Figure 5C:
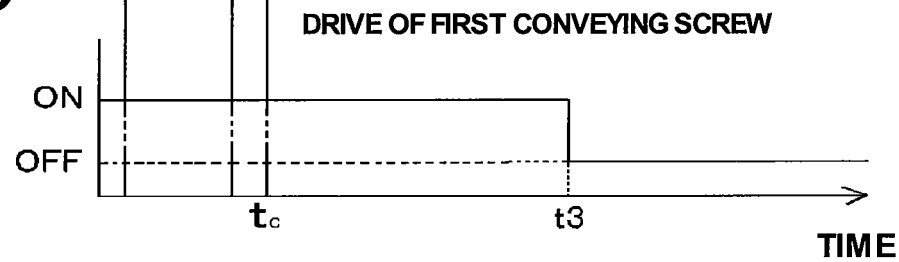

FIGS. 5A, 5B and 5C are graphs which illustrate a situation of sequential stopping of the developing sleeve 8, the second conveying screw 6 and the first conveying screw 5 while the respective drive stop trigger signals are transmitted with respectively shifted drive timings. As illustrated in FIGS. 5A, 5B and 5C, by previously shifting the drive stop timings with consideration of the difference among the inertia forces of the developing sleeve 8, the second conveying screw 6 and the first conveying screw 5, the circulation balance of the developer T can be maintained appropriately based on the actual stop turnaround times.

As illustrated in FIG. 5A, for example, the developing sleeve 8 is switched from ON (as indicated "ON" in the figures) to OFF (as indicated "OFF" in the figures) at time $t_A$. Then, actually, the developing sleeve 8 is stopped at t1. Meanwhile, as illustrated in FIG. 5B, for example, the second conveying screw 6 is switched from ON to OFF at time $t_B$. Then, actually, the second conveying screw 6 is stopped at t2. Further, as illustrated in FIG. 5C, for example, the first conveying screw 5 is switched from ON to OFF at time $t_C$. Then, actually, the first conveying screw 5 is stopped at t3. In FIGS. 5A, 5B and 5C, time lapses in the order of $t_A$, $t_B$, $t_C$, t1, t2 and t3. Further, the relation of the stop turnaround times is as the expression of "the first stop turnaround time ($t1-t_A$)>the second stop turnaround time ($t2-t_B$)≈the third stop turnaround time ($t3-t_C$)". The controller 30 sequentially triggers the stopping of rotation of the developing sleeve 8, the second conveying screw 6 and the first conveying screw 5 based the stop turnaround times, so that the stopping of rotation can be reliably actualized in the order of the developing sleeve 8, the second conveying screw 6 and the first conveying screw 5.

Figure 6A:
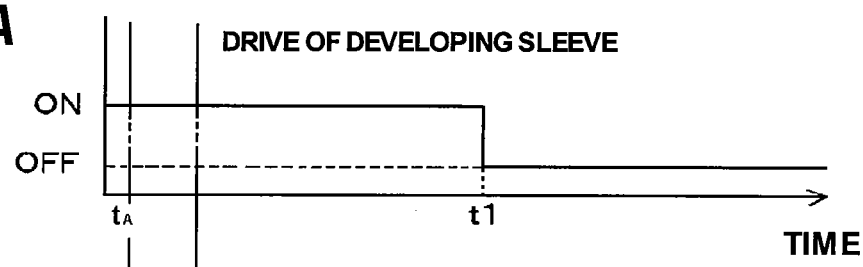
FIGS. 6A, 6B and 6C are graphs which illustrate a situation of simultaneous stopping of the developing sleeve, the second conveying screw and the first conveying screw while the respective drive stop trigger signals are transmitted with respectively shifted drive timings thereof.
Figure 6B:
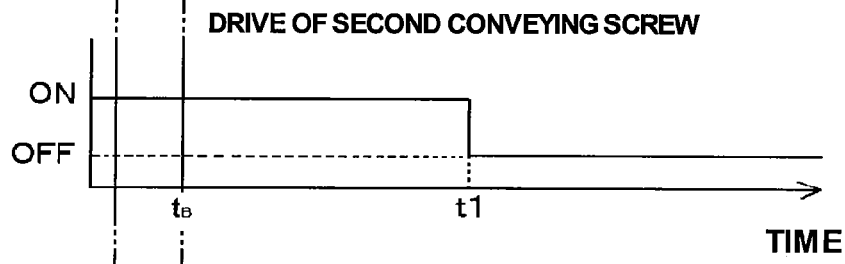
Figure 6C:
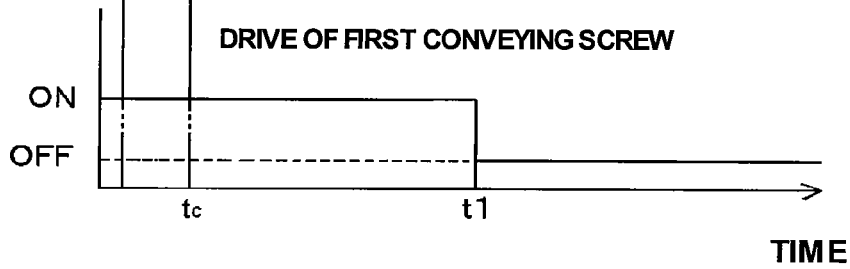

FIGS. 6A, 6B and 6C are graphs which illustrate a situation of simultaneous stopping of the developing sleeve 8, the second conveying screw 6 and the first conveying screw 5 while the respective drive stop trigger signals are transmitted with respectively shifted drive timings. As illustrated in FIGS. 6A, 6B and 6C, by previously shifting the drive stop timings in consideration of the difference among the inertia forces of the developing sleeve 8, the second conveying screw 6 and the first conveying screw 5, the circulation balance of the developer T can be maintained appropriately based on the actual stop turnaround times, as well.

As illustrated in FIG. 6A, for example, the developing sleeve 8 is switched from ON (as indicated "ON" in the figures) to OFF (as indicated "OFF" in the figures) at time $t_A$. Then, actually, the developing sleeve 8 is stopped at t1. Meanwhile, as illustrated in FIG. 6B, for example, the second conveying screw 6 is switched from ON to OFF at time $t_B$. Then, actually, the second conveying screw 6 is stopped at t1. Further, as illustrated in FIG. 6C, for example, the first conveying screw 5 is switched from ON to OFF at time $t_C$. Then, actually, the first conveying screw 5 is stopped at t1. In FIGS. 6A, 6B and 6C, time lapses in the order of $t_A$, $t_B$, $t_C$ and t1. Further, the relation of the stop turnaround times is as the expression of "the first stop turnaround time ($t1-t_A$)>the second stop turnaround time ($t1-t_B$)≈the third stop turnaround time ($t1-t_C$)". The controller 30 sequentially triggers the stopping of rotation of the developing sleeve 8, the second conveying screw 6 and the first conveying screw 5 based the stop turnaround times, so that the simultaneous stopping of rotation of the developing sleeve 8, the second conveying screw 6 and the first conveying screw 5 can be reliably actualized.

Here, in FIGS. 5 and 6, it is assumed that the drive stop trigger signals for the developing sleeve 8, the second conveying screw 6 and the first conveying screw 5 are transmitted at the same timing. In this case, since there is a difference among the inertia forces of the developing sleeve 8, the second conveying screw 6 and the first conveying screw 5, there arises a difference among the stop turnaround times from the transmitting of the drive stop trigger signal to the actual stopping of drive. As a result, the developing sleeve 8 is still rotated after the first conveying screw 5 and the second conveying screw 6 are stopped. This is a drawback of the related art.

In this example, in particular, when the drive of the second conveying screw 6 is stopped earlier than that of the developing sleeve 8, the developer T collected from the developing sleeve 8 into the agitating chamber 4 is accumulated at the upstream side of the second conveying screw 6 in the agitating chamber 4. Since the second conveying screw 6 is previously stopped, the accumulated developer T remains accumulated without being conveyed. Then, when the starting and stopping of the drive of the developing sleeve 8 and the second conveying screw 6 are repeated, there arises a risk that the circulation of the developer T becomes out of balance to cause overflowing of the developer T at the vicinity of the communicating portion 71 where the developer T is prone to be accumulated.

Next, the operation of the developing apparatus 1 is described with reference to FIG. 2. The developer T is drawn to the developing sleeve 8 by the magnetic pole N1. When the developing sleeve 8 is rotated, the developer T is magnetically regulated by the developer regulating edge 9 and conveyed sequentially to the magnetic pole S1 and the magnetic pole N2. Then, the developer T arrives at the developing area having the magnetic pole S2 therein. The remaining developer T without being consumed for the developing at the developing area is conveyed into the developer container 2 by the magnetic pole N3. The developer T is removed from the developing sleeve 8 by the repulsing magnetic field of the adjacent magnetic poles N1, N3 and collected into the agitating chamber 4.

The controller 30 previously stores the first stop turnaround time from the transmitting of the first drive stop trigger signal for stopping the drive of the developing sleeve 8 until the stopping of the drive of the developing sleeve 8. Further, the controller 30 stores the second stop turnaround time from the transmitting of the second drive stop trigger signal for stopping the drive of the second conveying screw 6 until the stopping of the drive of the second conveying screw 6. Furthermore, the controller 30 stores the third stop turnaround time from the transmitting of the first drive stop trigger signal for stopping the drive of the first conveying screw 5 until the stopping of the drive of the first conveying screw 5.

The controller 30 controls the developing sleeve 8 to be stopped after the first stop turnaround time lapses from the transmitting of the first drive stop trigger signal. Further, the controller 30 controls the second conveying screw 6 to be stopped after the second stop turnaround time lapses from the transmitting of the second drive stop trigger signal. After calculating the stop timing with the first stop turnaround time and the second stop turnaround time, the controller 30 stops the drive of the developing sleeve 8 earlier than that of the second conveying screw 6. The second conveying screw 6 may still be driven at the time when the developing sleeve 8 is stopped. Since the developer T is agitated and conveyed to the developing chamber 3 with the drive of the second conveying screw 6, the developer T is not excessively accumulated at the upstream side of the second conveying screw 6 in the agitating chamber 4.

Further, the controller 30 controls the second conveying screw 6 to be stopped after the second stop turnaround time lapses from the transmitting of the second drive stop trigger signal. Furthermore, the controller 30 controls the first conveying screw 5 to be stopped after the third stop turnaround time lapses from the transmitting of the third stop trigger signal. With the second stop turnaround time and the third stop turnaround time, the controller 30 stops the drive of the second conveying screw 6 to be earlier than that of the first conveying screw 5. The first conveying screw 5 may be still rotated at the time when the second conveying screw 6 is stopped. Thus, the developer T is not excessively accumulated in the developing chamber 3, in particular, at the communicating portion 71.

With the configuration of the developing apparatus 1, the timing for triggering the drive stop of the developing sleeve 8 is to be earlier than that of the second conveying screw 6. Accordingly, compared to the related art of simultaneous drive stop timing of the developing sleeve 8 and the second conveying screw 6, the drive stop timing of the developing sleeve 8 is advanced. In the related art, the developing sleeve 8 remains driven after the second conveying screw 6 is stopped due to the inertia force difference and the like and the phenomenon of overflowing of the developer in the developing apparatus may occur. However, such a phenomenon can be suppressed. Thus, even though there is a difference between the stop turnaround times due to the inertia force difference between the developing sleeve 8 and the second conveying screw 6, it can be suppressed that the developer T overflows from the developing apparatus 1 with the imbalance of the developer circulation. In the meantime, the developer T is effectively collected from the developing sleeve 8.

Further, with the configuration of the developing apparatus 1, the timing for triggering the drive stop of the second conveying screw 6 is to be earlier than that of the first conveying screw 5. Accordingly, compared to the related art of simultaneous drive stop timing of the second conveying screw 6 and the first conveying screw 5, the drive stop timing of the second conveying screw 6 is advanced. In the related art, the second conveying screw 6 remains driven after the first conveying screw 5 is stopped due to the inertia force difference and the like and the phenomenon of overflowing of the developer in the developing apparatus may occur. However, such a phenomenon can be suppressed. Thus, even though there is a difference between the stop turnaround times due to the inertia force difference between the second conveying screw 6 and the first conveying screw 5, it can be suppressed that the developer T overflows from the developing apparatus 1 with the imbalance of the developer circulation. In the meantime, the developer T is effectively collected from the developing sleeve 8.

As above-mentioned, when the drive of the developing sleeve 8 and the second conveying screw 6 is to be stopped, there is difference between the inertia forces thereof. Accordingly, in the related art, there is a case that the developing sleeve 8 remains rotated even after the second conveying screw 6 is stopped and that the developing sleeve 8 moves the developer T from the developing sleeve 8 into the agitating chamber 4. Thus, there is a case that the circulation of the developer T becomes out of balance and the developer T overflows from the developing apparatus.

With the configuration of the developing apparatus 1, since the developing chamber 3 and the agitating chamber 4 are arranged up and down, the occupying space in the horizontal direction can be saved. For example, downsizing can be achieved even with a color image forming apparatus of a tandem type including a plurality of developing apparatuses 1 to be mounted in parallel in the horizontal direction.

Further, with the configuration of the developing apparatus 1, the drive of the second conveying screw 6 is stopped when or after the drive of the developing sleeve 8 is stopped based on the stop turnaround time data. Accordingly, even when the stop turnaround time is varied corresponding to variation of torque applied to the developing sleeve 8 and the second conveying screw 6 with usage time, the circulation balance of the developer T is appropriately maintained.

Figure 7:
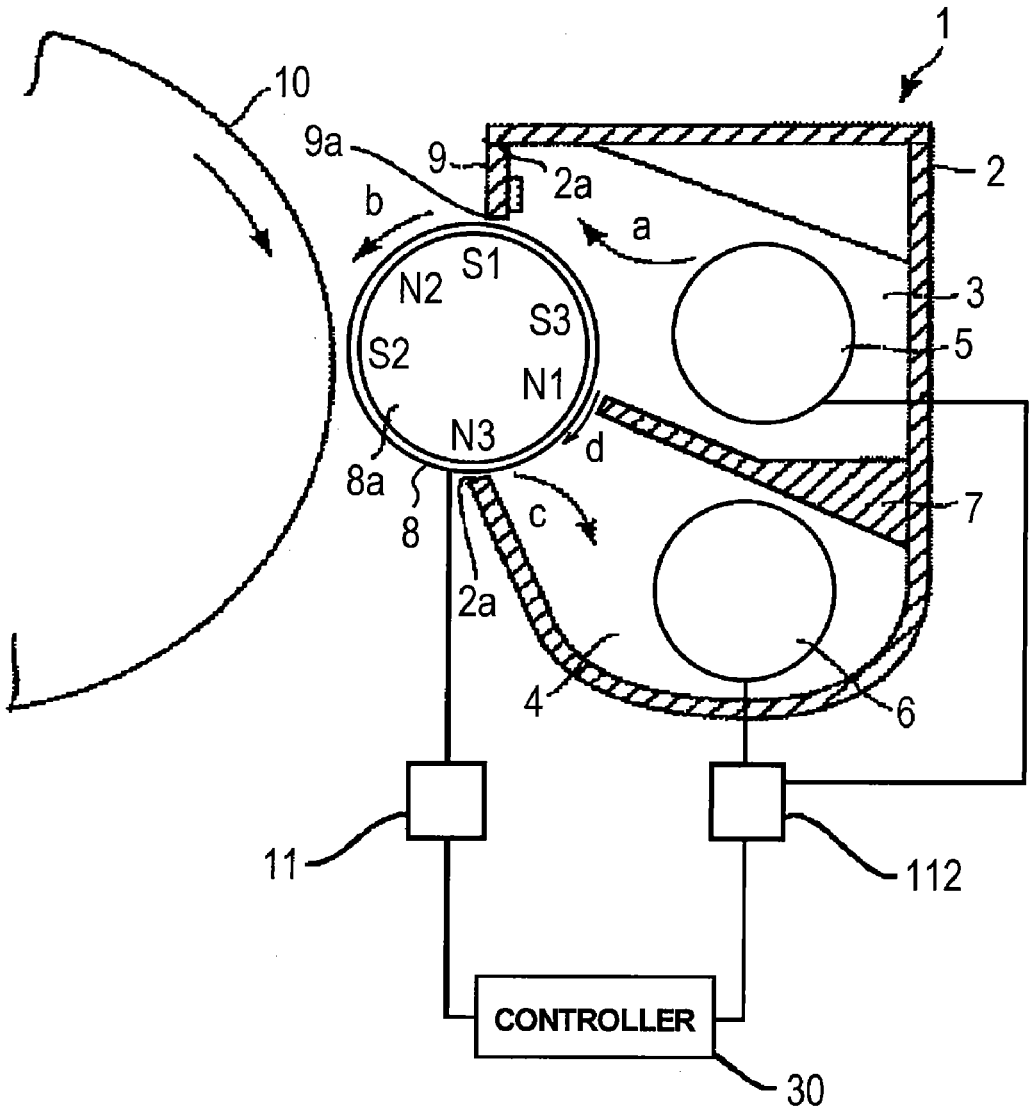
FIG. 7 is an enlarged sectional view which illustrates the configuration of the photosensitive drum and the developing apparatus according to a modification of the first embodiment of the present invention.

FIG. 7 is an enlarged sectional view which illustrates the configuration of the photosensitive drum 10 and the developing apparatus 1 according to a modification of the first embodiment of the present invention. In the above-mentioned embodiment, the developing sleeve 8 and the second conveying screw 6 can be driven independently. However, not limited to this, it is also possible that the developing sleeve 8 and the second conveying screw 6 are driven with a single drive mechanism 112 and are capable of being switched between ON and OFF with a clutch, as illustrated in FIG. 7.

Here, in the present embodiment, the required time for the drive stopping of the developing sleeve 8 which is driven at the same speed as the second conveying member in the normal image forming is longer than the required time for the drive stopping of the second conveying screw 6 in the state that the developer T is accommodated in the developing apparatus 1. However, the present invention is also applicable to the case that the required time for the drive stopping of the developing sleeve 8 which is driven at the same speed as in the normal image forming is shorter than the required time for the drive stopping of the second conveying screw 6 which is driven at the same speed as in the image forming in the state that the developer T is accommodated in the developing apparatus 1.

In the present embodiment, the stop turnaround time is varied in accordance with usage time even without the inertia difference among the developing sleeve 8, the second conveying screw 6 and the first conveying screw 5. When the present invention is applied to such a case, the above-mentioned developer overflowing can be suppressed by setting the stop timing of the drive input for the developing sleeve 8 to be earlier than that for the second conveying screw 6.

Here, the present embodiment is described with the case that the difference between the stop timing of the drive input for the developing sleeve 8 and the stop timing of the drive input for the second conveying screw 6 is invariable, as an example. However, it is also possible that the difference is varied in accordance with usage time. For example, in the case that usage time of the developer in the developing chamber 3 is increased, the required time for stopping the screw prone to be shortened due to increase of agglomeration degree of the developer. Therefore, the difference between the stop timing of the drive input for the developing sleeve 8 and that for the second conveying screw 6 may be prolonged in accordance with usage time. With this configuration, the rotation time of the developing sleeve 8 after the rotation of the second conveying screw 6 is stopped can be suppressed or the rotation of the developing sleeve 8 can be stopped before the rotation of the second conveying screw 6 is stopped. In this manner, the developer overflowing can be suppressed.

Second Embodiment

Figure 8:
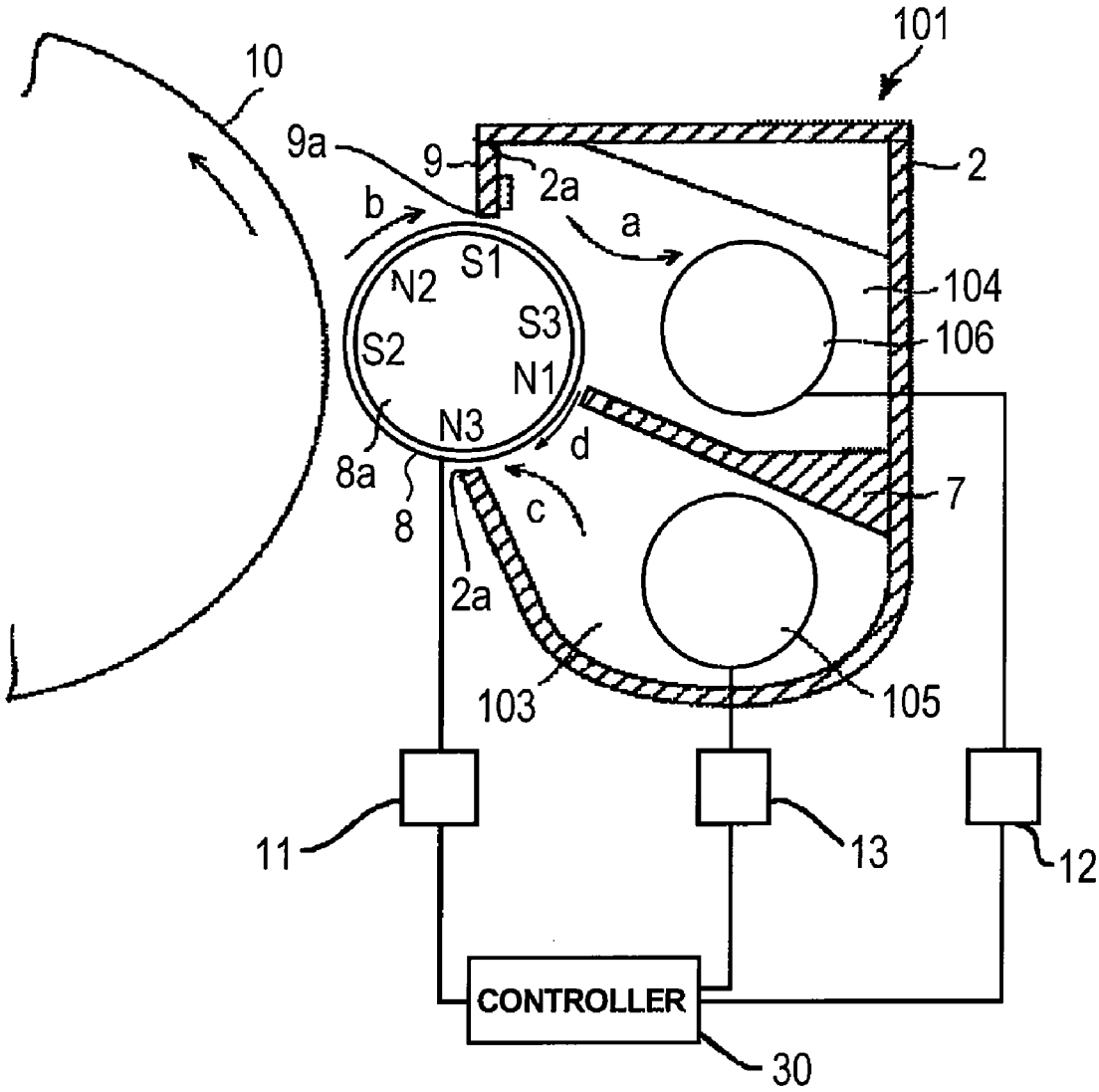
FIG. 8 is an enlarged sectional view which illustrates the configuration of the photosensitive drum and the developing apparatus according to a second embodiment of the present invention.
Figure 9:
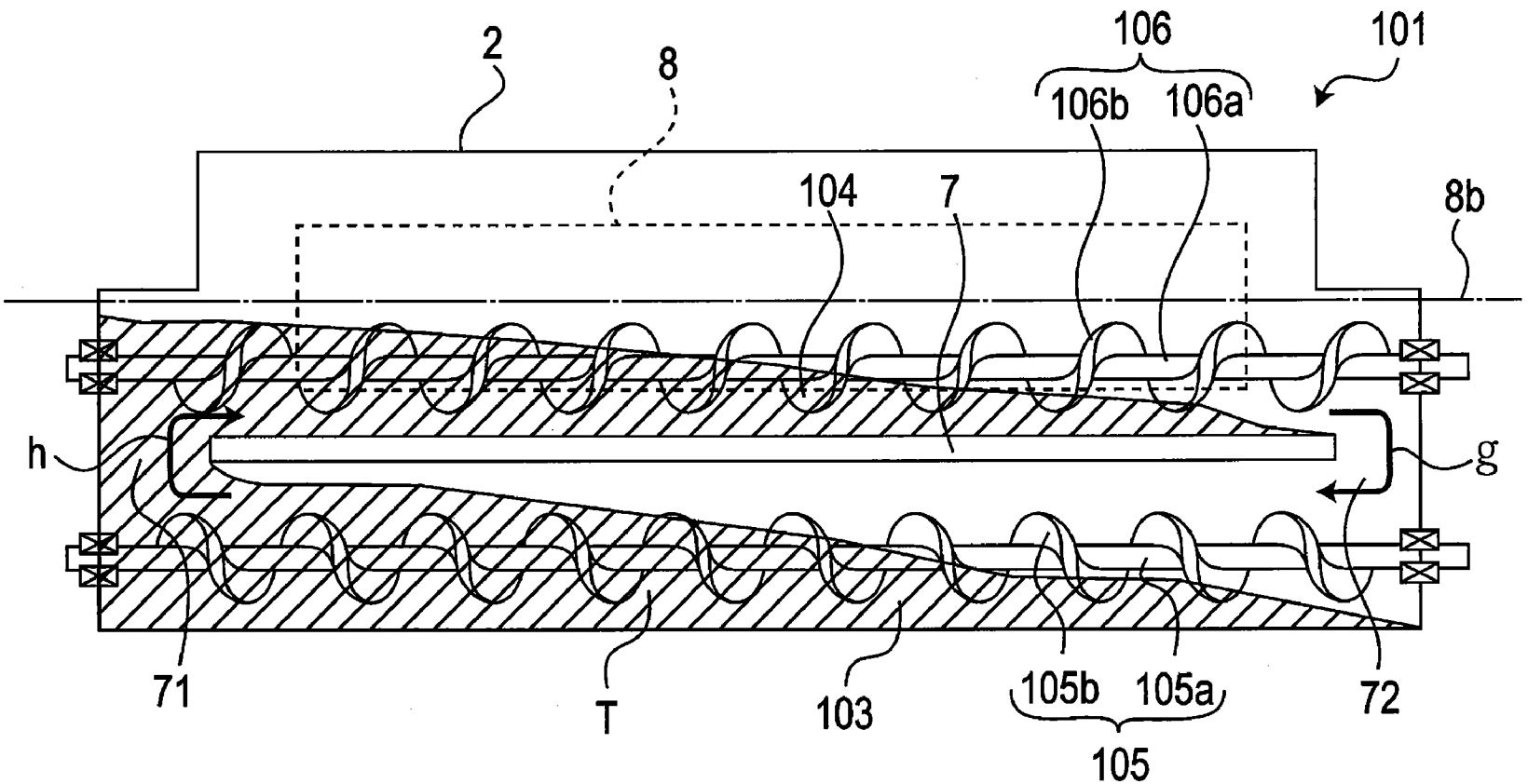
FIG. 9 is a sectional view which illustrates the configuration of the developing apparatus.

FIG. 8 is an enlarged sectional view which illustrates the configuration of the photosensitive drum 10 and a developing apparatus 101 according to a second embodiment of the present invention. FIG. 9 is a sectional view which illustrates the configuration of the developing apparatus 101. The same numeral is given to the similar part to the photosensitive drum 10 and the developing apparatus 1 of the first embodiment and the description will not be repeated. In the following, description will be made only for the distinctive configuration of the developing apparatus 101 according to the second embodiment. The developing apparatus 101 differs from the developing apparatus 1 in that a developing chamber 103 is arranged below the partition wall 7 in the developer container 2 and an agitating chamber 104 is arranged above the partition wall 7 in the developer container 2. Then, a first conveying screw 105 is arranged within the developing chamber 103 and a second conveying screw 106 is arranged within the agitating chamber 104.

Namely, the partition wall 7 is formed at the approximate center of the inside of the developer container 2. The partition wall 7 partitions, within the developer container 2, the developing chamber 103 as the first chamber capable of accommodating the developer T for developing therewith and the agitating chamber 104 as the second chamber for forming the circulation passage in communication with the developing chamber 103 and for agitating the developer T while being capable of accommodating the developer T. The developing chamber 103 is defined at the lower side in the developer container 2. The agitating chamber 104 is defined at the upper side in the developer container 2. Namely, the agitating chamber 104 is arranged above the developing chamber 103 in the gravitational direction. The developer T is accommodated in the developer container 2 having the agitating chamber 104 and the developing chamber 103 which are arranged up and down.

The first conveying screw 105 as the first conveying member which agitates the developer T in the developing chamber 103 and conveys to the developing sleeve 8 is arranged in the developing chamber 103. The second conveying screw 106 as the second conveying member which agitates the developer T in the agitating chamber 104 and conveys to the developing chamber 103 when the developer T remained at the developing sleeve 8 is collected into the agitating chamber 104 is arranged in the agitating chamber 104. The first conveying screw 105 or the second conveying screw 106 functions as the circulation unit for circulating the developer T within the developer container 2. Further, the motor 11 is connected to the developing sleeve 8, the motor 13 is connected to the first conveying screw 105, and the motor 12 is connected to the second conveying screw 106. The motors 11 to 13 are connected to the controller 30. As illustrated in FIG. 9, the first conveying screw 105 includes a rotation shaft 105*a* and a blade member 105*b*. The second conveying screw 106 includes a rotation shaft 106*a* and a blade member 106*b*. Here, the rotation direction of the first conveying screw 105 is the same direction as that of the second conveying screw 6 of the first embodiment. Then, the rotation direction of the second conveying screw 106 is the same direction as that of the first conveying screw 5 of the first embodiment.

The developing apparatus 101 is operated as follows. As illustrated in FIG. 8, the photosensitive drum 10 is rotated counterclockwise as indicated by an arrow. Meanwhile, the developing sleeve 8 is rotated clockwise. In the developing apparatus 101, the toner in the developing chamber 103 is borne on the developing sleeve 8 due to the rotation of the first conveying screw 105. Subsequently, the toner is transferred to the photosensitive drum 10 from the developing sleeve 8. The remaining toner is conveyed to the agitating chamber 104. The toner in the agitating chamber 104 is conveyed to the developing chamber 103 through the communicating portion 72 with the rotation of the second conveying screw 106 as indicated by arrow g.

In this case, the controller 30 sequentially transmits the first drive stop trigger signal, the third drive stop trigger signal and the second drive stop trigger signal in such order. Accordingly, the rotation is stopped in the order of the developing sleeve 8, the first conveying screw 105 and the second conveying screw 106. In this case as well, the actual order of the stop timings of the developing sleeve 8, the second conveying screw 106 and the first conveying screw 105 may be transposed within a predetermined time range.

Here, the drive stop timing of the second conveying screw 106 is set to be earlier than or equal to the drive stop timing of the first conveying screw 105 in consideration with the pressure applied to the developer at the communicating portion 71 to be utilized for the drawing in the direction of arrow h. Assuming that the rotation of the first conveying screw 105 in the developing chamber 103 is stopped after the rotation of the second conveying screw 106 in the agitating chamber 104, the pressure of the developer is increased at the connecting portion 71 by the rotation of the second conveying screw 6 and the developer is deteriorated. The above-mentioned setting is for suppressing such deterioration.

With the configuration of the developing apparatus 101, the timing for triggering the drive stop of the developing sleeve 8 is to be earlier than that of the second conveying screw 106. Accordingly, compared to the related art of simultaneous drive stop timing of the developing sleeve 8 and the second conveying screw 106, the drive stop timing of the developing sleeve 8 is advanced. In the related art, the developing sleeve 8 remains driven after the second conveying screw 106 is stopped due to the inertia force difference and the like and the phenomenon of overflowing of the developer in the developing apparatus 1 may occur. However, such a phenomenon can be suppressed. Thus, even though there is a difference between the stop turnaround times due to the inertia force difference between the developing sleeve 8 and the second conveying screw 106, it can be suppressed that the developer T overflows from the developing apparatus 1 with the imbalance of the developer circulation. In the meantime, the developer T is effectively collected from the developing sleeve 8.

Further, with the configuration of the developing apparatus 101, the timing for triggering the drive stop of the second conveying screw 106 is to be earlier than that of the first conveying screw 105. Accordingly, compared to the related art of simultaneous drive stop timings of the second conveying screw 106 and the first conveying screw 105, the drive stop timing of the first conveying screw 105 can be delayed. In the related art, the second conveying screw 106 remains driven after the first conveying screw 105 is stopped due to the inertia force difference and the like and the phenomenon of overflowing of the developer in the developing apparatus 1 may occur. However, such a phenomenon can be suppressed. Thus, even though there is a difference between the stop turnaround times due to the inertia force difference between the second conveying screw 106 and the first conveying screw 105, it can be suppressed that the developer T overflows from the developing apparatus 1 with the imbalance of the developer circulation. In the meantime, the developer T is effectively collected from the developing sleeve 8.

Figure 10:
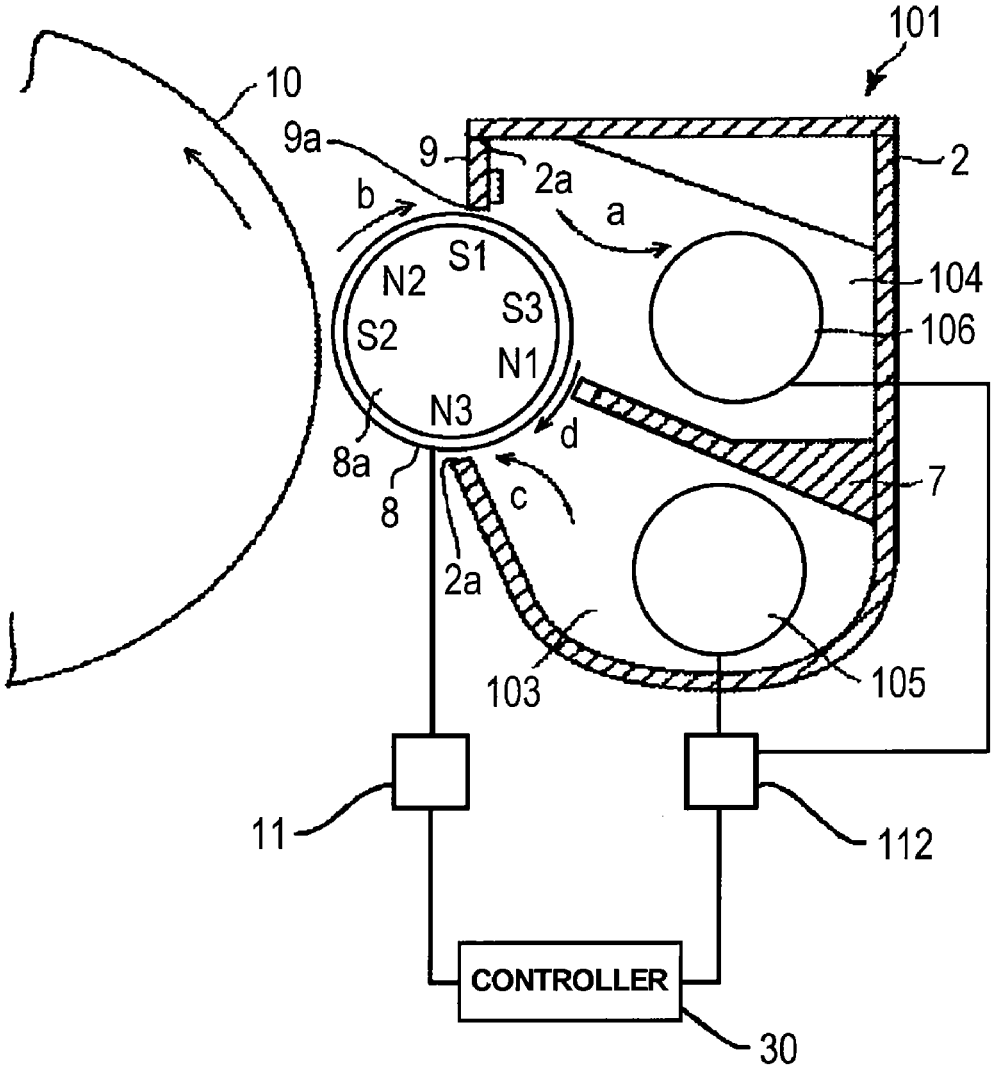
FIG. 10 is an enlarged sectional view which illustrates the configuration of the photosensitive drum and the developing apparatus according to a modification of the second embodiment of the present invention.

FIG. 10 is an enlarged sectional view which illustrates the configuration of the photosensitive drum 10 and the developing apparatus 101 according to a modification of the second embodiment of the present invention. In the above-mentioned embodiment, the second conveying screw 106 and the first conveying screw 105 can be driven independently. However, not limited to this, it is also possible that the second conveying screw 106 and the first conveying screw 105 are driven with a single drive mechanism 112 and are capable of being switched between ON and OFF with a clutch, as illustrated in FIG. 10.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-271571, filed Oct. 22, 2008, which is hereby incorporated by reference herein in its entirety.

What is claimed is:

1. An image forming apparatus comprising:

a first chamber which is capable of accommodating developer;

a second chamber which is capable of accommodating developer and forms a circulation passage in communication with the first chamber;

a first conveying member which is arranged in the first chamber and conveys developer from one end to the other end of the first chamber;

a second conveying member which is arranged in the second chamber and conveys developer from one end to the other end of the second chamber;

a developer bearing member which bears developer supplied from the first chamber and conveys the developer to the second chamber via a developing position opposed to an image bearing member;

a drive mechanism which drives the developer bearing member, the first conveying member and the second conveying member; and a controller which controls drive of the drive mechanism so that stop timing of drive input for the developer bearing member is to be earlier than stop timing of drive input for the second conveying member when stopping drive of the developer bearing member in accordance with image forming completion.

2. The image forming apparatus according to claim 1, wherein the controller controls the drive mechanism so that the stop timings of the drive input for the first conveying member and the second conveying member are to be substantially simultaneous when stopping the drive inputs of the first conveying member and the second conveying member in accordance with image forming completion.

3. The image forming apparatus according to claim 1, wherein the second chamber is arranged below the first chamber in the gravitational direction, and wherein the controller controls the drive mechanism so that the stop timing of the drive input for the first conveying member is to be later than the stop timing of the drive input for the second conveying member when stopping the drive inputs for the first conveying member and the second conveying member in accordance with image forming completion.

4. The image forming apparatus according to claim 1, wherein the controller controls the drive mechanism so that the drive input of the second conveying member is stopped after rotation of the developer bearing member is stopped.

5. The image forming apparatus according to claim 1, wherein the drive mechanism is controlled so that a difference between the stop timing of the drive input for the developer bearing member and the stop timing of the drive input for the second conveying member becomes large corresponding to an increase of usage time when stopping drive of the developer bearing member in accordance with image forming completion.

6. The image forming apparatus according to claim 1, wherein the time required for stopping drive of the developer bearing member which is driven at the same speed as the second conveying member in image forming is longer than the time required for stopping drive of the second conveying member.

* * * * *